US009016380B2

(12) United States Patent
Burgon et al.

(10) Patent No.: US 9,016,380 B2
(45) Date of Patent: Apr. 28, 2015

(54) STAB PLATES AND SUBSEA CONNECTION EQUIPMENT

(75) Inventors: Terence Burgon, Crowmarsh (GB); Terry Rackham, Slough (GB)

(73) Assignee: M.S.C.M. Limited, Marlow, Buckinghamshire (GB)

( * ) Notice: Subject to any disclaimer, the term of this patent is extended or adjusted under 35 U.S.C. 154(b) by 542 days.

(21) Appl. No.: 13/337,546

(22) Filed: Dec. 27, 2011

(65) Prior Publication Data

US 2012/0175124 A1 Jul. 12, 2012

(51) Int. Cl.
*E21B 7/12* (2006.01)
*E21B 33/038* (2006.01)

(52) U.S. Cl.
CPC ..... *E21B 33/038* (2013.01)

(58) Field of Classification Search
CPC ..... E21B 17/02
USPC ..... 166/338, 341, 344, 360
See application file for complete search history.

(56) References Cited

U.S. PATENT DOCUMENTS

| | | | | | |
|---|---|---|---|---|---|
| 3,036,814 | A | * | 5/1962 | Stevens | 251/299 |
| 3,089,454 | A | * | 5/1963 | Chronic | 440/41 |
| 3,605,414 | A | * | 9/1971 | Westmoreland, Jr. | 5/224 |
| 3,817,281 | A | * | 6/1974 | Lewis et al. | 137/594 |
| 3,820,600 | A | * | 6/1974 | Baugh | 66/338 |
| 3,913,951 | A | * | 10/1975 | LeFebvre, Jr. | 285/223 |
| 4,262,748 | A | * | 4/1981 | Kirkland | 166/348 |
| 4,291,724 | A | * | 9/1981 | Miller | 137/555 |
| 4,295,390 | A | * | 10/1981 | Buchta | 74/625 |
| 4,356,998 | A | * | 11/1982 | Bach et al. | 251/354 |
| 4,411,454 | A | * | 10/1983 | Nayler et al. | 285/26 |
| 4,444,218 | A | | 4/1984 | Baugh | |
| 4,460,156 | A | * | 7/1984 | Hazelrigg et al. | 251/149.3 |
| 4,518,042 | A | * | 5/1985 | Miller | 166/347 |
| 4,899,822 | A | * | 2/1990 | Daeschler et al. | 166/339 |
| 5,127,681 | A | * | 7/1992 | Thelen et al. | 285/121.7 |
| 5,398,761 | A | * | 3/1995 | Reynolds et al. | 166/344 |
| 5,595,254 | A | * | 1/1997 | Tibbitts | 175/320 |
| 5,794,701 | A | * | 8/1998 | Cunningham et al. | 166/341 |
| 6,142,233 | A | * | 11/2000 | Wilkins | 166/339 |
| 6,161,618 | A | * | 12/2000 | Parks et al. | 166/351 |
| 6,269,495 | B1 | * | 8/2001 | Sondrup | 4/679 |
| 6,644,410 | B1 | * | 11/2003 | Lindsey-Curran et al. | 166/360 |
| 7,073,593 | B2 | * | 7/2006 | Hatton et al. | 166/367 |
| 7,216,715 | B2 | * | 5/2007 | Reynolds | 166/339 |
| 7,243,729 | B2 | * | 7/2007 | Tyrrell et al. | 166/338 |
| 7,641,487 | B2 | * | 1/2010 | Morgan | 439/158 |

(Continued)

OTHER PUBLICATIONS

Search Report for GB1022051.5 dated Feb. 25, 2011.

*Primary Examiner* — Matthew Buck
*Assistant Examiner* — Aaron Lembo
(74) *Attorney, Agent, or Firm* — Nixon & Vanderhye P.C.

(57) ABSTRACT

A subsea connection assembly has a stab plate a first stab plate which carries a first plurality of couplers and a second stab plate which carries a second plurality of couplers for mating engagement with the couplers in the first plurality as the stab plates are moved together. The assembly includes a mounting plate, a support which is disposed for lateral movement in at least one direction relative to the mounting plate, and a pivot which allows tilting movement of the first stab plate relative to the support. The tilting and translational features accommodate many different possible trajectories of a pulling unit. In particular, the assembly tolerates a separating action which is oblique to the normal mating and demating direction.

21 Claims, 3 Drawing Sheets

(56) References Cited

U.S. PATENT DOCUMENTS

| | | | | |
|---|---|---|---|---|
| 7,717,471 | B2 * | 5/2010 | Langenfeld et al. | 285/38 |
| 8,011,434 | B2 * | 9/2011 | Cosgrove et al. | 166/341 |
| 8,122,964 | B2 * | 2/2012 | Judge et al. | 166/341 |
| 8,127,852 | B2 * | 3/2012 | Judge et al. | 166/341 |
| 8,316,948 | B2 * | 11/2012 | Stringfellow et al. | 166/367 |
| 8,322,429 | B2 * | 12/2012 | Judge et al. | 166/341 |
| 8,464,797 | B2 * | 6/2013 | Singh et al. | 166/340 |
| 8,550,167 | B2 * | 10/2013 | Comeaux et al. | 166/338 |
| 8,550,168 | B2 * | 10/2013 | Hamblin et al. | 166/341 |
| 2004/0154804 | A1 | 8/2004 | Williams | |
| 2008/0143100 | A1 * | 6/2008 | Webster | 285/18 |
| 2009/0038805 | A1 * | 2/2009 | Parks et al. | 166/341 |
| 2012/0168168 | A1 * | 7/2012 | Cruden | 166/338 |

* cited by examiner

STAB PLATES AND SUBSEA CONNECTION EQUIPMENT

PRIORITY

This application claims priority from GB patent application No. 1022051.5 filed Dec. 29, 2010, the disclosure of which is incorporated by reference.

FIELD OF THE INVENTION

The present invention relates to stab plates such as are in use in subsea installations, particularly although not necessarily exclusively in conjunction with equipment for the control of extraction of fluid hydrocarbons.

BACKGROUND TO THE INVENTION

Stab plates for this purpose normally come in pairs, one stab plate carrying a plurality of couplers (which may be hydraulic or electrical) which can be mated with respective coupler on the other stab plate as the plates are moved together.

The invention particularly concerns a stab plate which has a much improved tolerance for initial mis-alignment and/or obliquity of approach of the stab plates and also for the effects of separating forces oblique to the direction in which the couplers mate. One preferred form of the invention is a load bearing stab plate assembly which should be able to separate without damage following an emergency failure of a nearby unit that it controls. As will be explained, it incorporates tilting and translational features to accommodate many different possible trajectories of a pulling unit. In particular the stab plate is adapted to allow a pulling action which is oblique to the normal mating and demating direction. The stab plate assembly preferably has capture features permitting an accurate alignment of mating parts for remote make up, separation and remake after separation.

BRIEF SUMMARY

In one aspect the exemplary embodiment provides a stab plate assembly comprising a stab plate which carries a plurality of couplers for cooperation with respective couplers on a complementary plate The assembly includes a mount, a support which is disposed for lateral movement in at least one direction relative to the mount, and a pivot which allows limited tilting movement of the stab plate relative to the support.

Preferably the support is disposed for lateral movement in two mutually perpendicular directions relative to the mount. The assembly may for this purpose include a first track provided on the mount, a second track, perpendicular to the first track, provided on a tracked member secured to said support, and an intermediate guide member disposed between the tracked member and the mount and engaging the tracks to allow the said lateral movement in said two mutually perpendicular directions. A securing member may extend from a cavity in the support through an aperture in the mount to said tracked member, which is disposed on the opposite side of the mount from the support. Preferably the said support is slidably disposed relative to the mount.

The exemplary stab plate preferably includes docking members disposed to cooperate with datum members on the complementary plate so as cause tilting and/or lateral movement of the stab plate whereby to orient the couplers in the plurality thereof relative to their respective couplers as the stab plates are moved together. The pivot preferably comprises a ball joint. The ball joint may include means for inhibiting rotation of the stab plate about an axis corresponding to the direction in which the couplers on the stab plate move to mate with the said respective couplers.

The exemplary embodiment also provides subsea connection equipment comprising a stab plate assembly comprising a first stab plate which carries a first plurality of couplers, and a second stab plate which carries a second plurality of couplers for mating engagement with the couplers in the first plurality as the stab plates are moved together and being releasable as the stab plates are separated. The stab plate assembly comprises a mounting plate, a support which is disposed for lateral movement in at least one direction relative to the mounting plate, and a pivot which allows tilting movement of the first stab plate relative to the support.

The exemplary equipment preferably includes a heavy-duty ball tilting unit mounted on a central ball post which is held on tracks permitting horizontal motion in at least one and preferably two mutually perpendicular axes (X and Y) relative to a fixed mount. It may be used in situations where a pair of stab plates containing hydraulic self-sealing couplings and/or electrical connections is to be made up by thrusting the stab plates together and, in an emergency, rapidly separated.

One emergency situation which may be envisaged is of a remote subsea connection of two stab plates in the control system to special equipment. If the special equipment is suddenly displaced (it could be remotely decoupled) it is required that the control system's stab plates should also separate without damage.

BRIEF DESCRIPTION OF THE DRAWINGS

One example of the invention will be described with reference to the accompanying drawings, in which.

DETAILED DESCRIPTION

Figure 1:
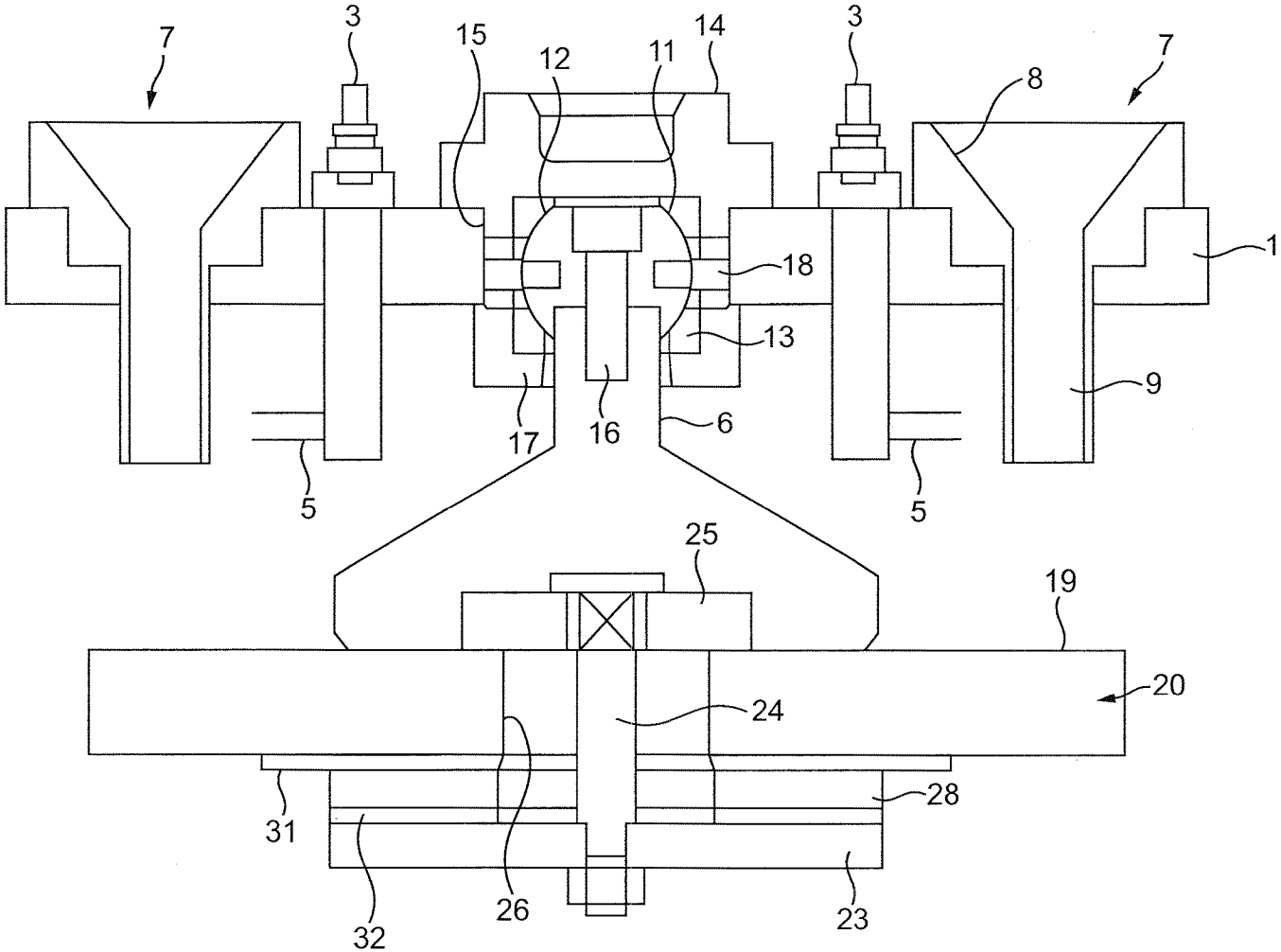
FIG. 1 is a schematic drawing of a stab plate according to the exemplary embodiment.
Figure 2:
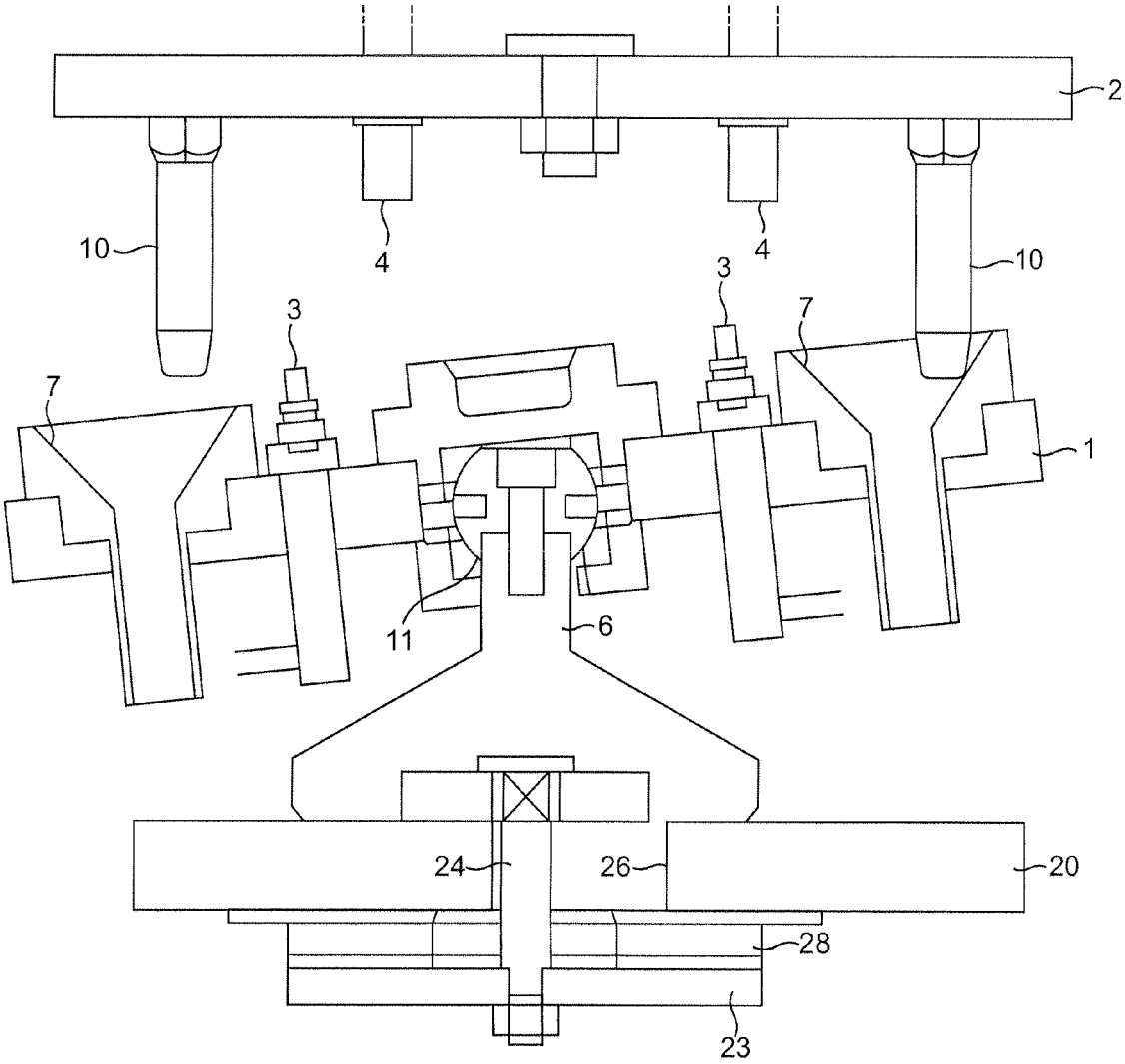
FIG. 2 is a schematic drawing of the stab plate approaching engagement with a complementary stab plate in an assembly according to the exemplary embodiment.

FIG. 1 illustrates a first stab plate 1, called herein 'lower' stab plate, which intended to cooperate with a second, or 'upper' stab plate 2, which is shown in FIG. 2. The stab plate 1 is populated with couplers 3, which project forwardly of the stab plate 1 in a direction normal to the general plane of the stab plate 1.

Only two couplers 3 are shown for the sake of simplicity. These couplers may be self-sealing hydraulic couplers as for example described in GB-2463966. Such couplers are employed in pairs, a 'male' or probe coupler on one stab plate being positioned to mate with a 'female' or socket coupler on the other stab plate. In this example the 'male' couplers are disposed on the lower stab plate and the female couplers 4 (see FIG. 2) are disposed on the upper stab plate 2.

However, the invention is not limited to such a disposition. The couplers may be electrical couplers and the stab plates may in general carry both hydraulic and electrical couplers.

In remote subsea use the stab plates are preferably pushed towards each other by a hydraulic ram with the aid of docking guides which orientate and align the respective couplers exactly before the couplings constituted by the pairs of couplers are fully engaged. Couplings in subsea use require large forces to engage and separate them. A make-up force of 25 tonnes and a demating force of 5 tonnes are common.

As shown in FIG. 1, each coupler 3 is associated with a line (in this example a hydraulic line) 5. These lead away from a post 6 on which the lower stab plate 1 is mounted.

At each side of the lower stab plate is a respective docking guide 7. This is in the form of a cone 8 which narrows to a throat 9. These guides 7 each cooperate with a respective datum member comprising a guide post 10 disposed on the upper guide; the cones capture the posts 10 and ensure proper alignment of the couplers before final engagement thereof occurs.

The lower stab plate 1 is as previously indicated pivotally mounted for limited tilting movement, preferably up to about 20° about any axis which is in or parallel to the general plane of the stab plate 1. For this purpose the support, i.e. the post 6, carries a ball 11 which has an upper annular bearing 12 and a lower annular bearing 13 disposed within a housing 14 secured within a central aperture 15 in the stab plate 1. The ball is secured to the post 6 by means of a bolt 16. The lower part of the housing has an annular flange 17 which extends around the post 6 and allows limited titling of the stab plate 1 relative to its support, the tilting being limited by engagement of the flange 17 with the post 6.

The ball 11 has equatorially located radially extending pins 18 which inhibit rotation of the stab plate about the axis of the post, i.e. about an axis generally normal to the plane of the stab plate and parallel to the direction in which final mating engagement (or initial demating) of the couplers occurs.

An important feature of the assembly shown in FIG. 1 is the mounting of the support post 6 such that it and thereby the stab plate 1 can move laterally (during a make up or releasing action) laterally relative to its mount in at least one and preferably two orthogonal directions (and thereby any direction). The post 6 has a broad base which is located on the upper surface 19 of a mounting plate 20 and can slide relative to the mounting plate 20.

Moreover, the assembly includes two tracks, extending in the two orthogonal directions, which allow the lateral movements of the post 6 relative to the mounting plate 20.

Figure 3:
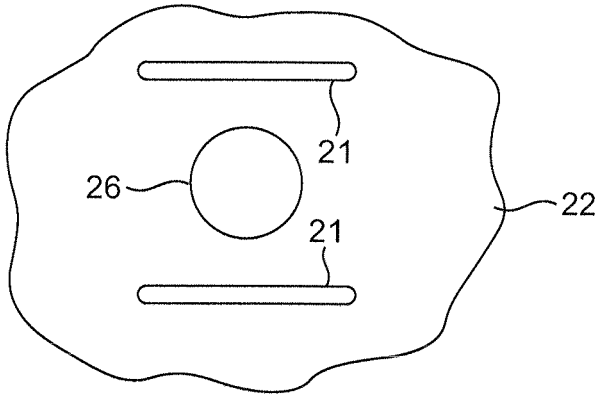
FIGS. 3 to 7 are drawings of various parts of the stab plate shown in FIG. 1 and also shown in the assembly shown in FIG. 2.

One of the tracks is provided on the mounting plate 20. With reference to FIG. 3, in this example this track is in the form of parallel slots 21 in the underside 22 of the mounting plate 20.

Figure 4:
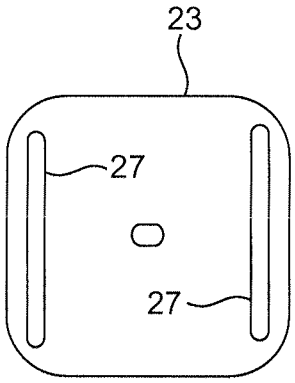

A second track is provided by a member 23 fixed to the post 6. The member 23 is in this example a plate which is secured to the post by a bolt 24 which extends from a cavity 25 in the post through a central aperture 26 in the mounting plate, the plate 23 being disposed in this example on the opposite side of the mounting plate from the post 6. The plate 23, as shown in FIG. 4, has two parallel slots 27, extending in a direction perpendicular to the direction of the slots 21 in the underside of the mounting plate.

Figure 5:
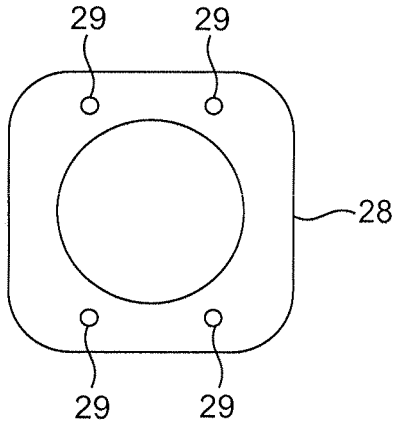
Figure 6:
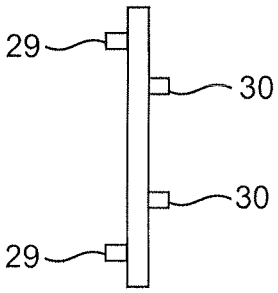
Figure 7:
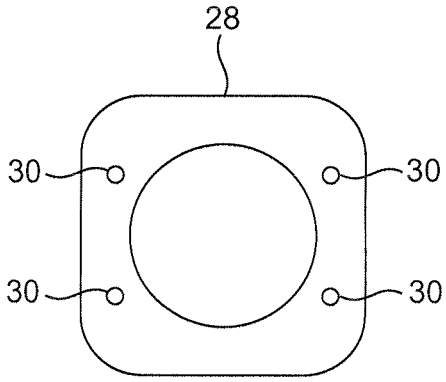

Between the plate 23 and the mounting plate 20 is an intermediate plate 28. FIG. 5 is a top view, FIG. 6 is a side view and FIG. 7 is an underneath view of the intermediate plate 28. On its top side the intermediate plate has a set of pins which engage the track slots 21, two pins engaging each slot, and on its underside the intermediate plate has pins 30 engaging the track slots 27, two pins engaging each slot to maintain alignment. Low friction strips 31 and 32 may be provided between the mounting plate and the intermediate plate 28 and between the intermediate plate 28 and the tracked plate 23 respectively.

The 'female' stab plate (i.e. the stab plate 2 holding the female couplers 4) is moved into engagement with the male plate 1 by (for example) a hydraulic ram (not shown). As the ram nears the male plate a docking guide 7 on the stab plate 1 engages the top of a guide post 10 mounted on the stab plate. The guide post 10 is pushed downwards by further motion of the ram until a similar pin 10 on the opposite side of the plate 2 engages its respective docking guide 7. This action has brought the two plates substantially parallel. Further motion of the ram causes the posts 10 to move the stab plate assembly along the tracks 21 and 27 so that the posts 10 are aligned with the capture bores 8. Further motion of the ram motion the couplings, now in correct alignment, to be fully made up.

After make up the ram can be pressurized to ensure that the high separation forces from unbalanced hydraulic couplings do not force the plates apart. A controlled demate of the stab plates may performed by lowering the ram pressure but removal of all mating pressure will not in practice separate the plates because normally (in the case of self-sealing hydraulic couplings) a vacuum is formed on closure of the couplers and the high separating pull referred to above is required.

A real need for the tilting and planar motions of the lower stab plate relative to the mounting plate occurs when the stab plates are in their normal made up working situation controlling special equipment which is designed so that in an emergency the special equipment is designed to unlatch from the structure and to be pulled clear. In these circumstances the stab plate 2 and the ram mechanism are fixed to the special equipment and must also break clear of the structure. Because the tie to the special equipment is from the side the mated stab plates have to tilt to an angle normal to the direction of pull. After this action the female stab plate and ram mechanism will remain hanging from the special equipment remotely and totally separate from the stab plate 1, which remains on the ball and track mounting on the structure. The mechanism suffers no damage in such separation and on refitting the special equipment the connection unit may be made up again.

What is claim is:

1. A stab plate assembly comprising:

a stab plate which carries a plurality of couplers for cooperation with respective couplers on a complementary plate;

the assembly including:

a mount;

a support which is disposed for lateral movement in at least one direction relative to said mount; and a pivot comprising a ball joint which allows tilting movement of said stab plate relative to said support.

2. The stab plate assembly of claim 1 in which said support is disposed for lateral movement in two mutually perpendicular directions relative to said mount.

3. The stab plate assembly of claim 2 and including:

a first track provided on said mount;

a tracked member secured to said support;

a second track, perpendicular to said first track, provided on said tracked member; and an intermediate guide member disposed between said tracked member and said mount and engaging said tracks to allow said lateral movement in said two mutually perpendicular directions.

4. The stab plate assembly of claim 3 wherein said support defines a cavity and a securing member extends from said cavity through said mount to said tracked member, which is disposed on the opposite side of said mount from said support.

5. The stab plate assembly of claim 1 wherein said support is slidably disposed relative to said mount.

6. The stab plate assembly of claim 1 wherein said stab plate includes docking members disposed to cooperate with datum members on said complementary plate so as to cause tilting and/or lateral movement of the stab plate whereby to orient the couplers relative to their respective couplers as the stab plates are moved together.

7. The stab plate assembly of claim 6 wherein said docking members comprise capturing cones.

8. The stab plate assembly of claim 1 wherein said ball joint includes means for inhibiting rotation of the stab plate about an axis corresponding to the direction in which said couplers move to mate with said respective couplers.

9. A stab plate assembly comprising:

a stab plate which carries a plurality of couplers for cooperation with respective couplers on a complementary plate;

the assembly including:

a mount;

a support which is disposed for lateral movement in two mutually perpendicular directions relative to said mount including a first track provided on said mount;

a tracked member secured to said support;

a second track, perpendicular to said first track, provided on said tracked member; and an intermediate guide member disposed between said tracked member and said mount and engaging said tracks to allow said lateral movement in said two mutually perpendicular directions; and a pivot which allows tilting movement of said stab plate relative to said support.

10. The stab plate assembly of claim 9 wherein said support defines a cavity and a securing member extends from said cavity through said mount to said tracked member, which is disposed on the opposite side of said mount from said support.

11. The stab plate assembly of claim 9 wherein said stab plate includes docking members disposed to cooperate with datum members on said complementary plate so as to cause tilting and/or lateral movement of the stab plate whereby to orient the couplers relative to their respective couplers as the stab plates are moved together.

12. The stab plate assembly of claim 11 wherein said docking members comprise capturing cones.

13. The stab plate assembly of claim 9 wherein said pivot comprises a ball joint.

14. The stab plate assembly of claim 13 wherein said ball joint includes means for inhibiting rotation of the stab plate about an axis corresponding to the direction in which said couplers move to mate with said respective couplers.

15. A stab plate assembly comprising:

a stab plate which carries a plurality of couplers for cooperation with respective couplers on a complementary plate;

said stab plate including capturing cone docking members disposed to cooperate with datum members on said complementary plate so as to cause tilting and/or lateral movement of the stab plate whereby to orient the couplers relative to their respective couplers as the stab plates are moved together;

the assembly including:

a mount;

a support which is disposed for lateral movement in at least one direction relative to said mount; and a pivot which allows tilting movement of said stab plate relative to said support.

16. The stab plate assembly of claim 15 in which said support is disposed for lateral movement in two mutually perpendicular directions relative to said mount.

17. The stab plate assembly of claim 16 and including a first track provided on said mount;

a tracked member secured to said support;

a second track, perpendicular to said first track, provided on said tracked member; and an intermediate guide member disposed between said tracked member and said mount and engaging said tracks to allow said lateral movement in said two mutually perpendicular directions.

18. The stab plate assembly of claim 17 wherein said support defines a cavity and a securing member extends from said cavity through said mount to said tracked member, which is disposed on the opposite side of said mount from said support.

19. The stab plate assembly of claim 15 wherein said support is slidably disposed relative to said mount.

20. The stab plate assembly of claim 15 wherein said pivot comprises a ball joint.

21. The stab plate assembly of claim 20 wherein said ball joint includes means for inhibiting rotation of the stab plate about an axis corresponding to the direction in which said couplers move to mate with said respective couplers.

* * * * *